United States Patent [19]

Bottum

[11] Patent Number: 4,488,413

[45] Date of Patent: Dec. 18, 1984

[54] SUCTION ACCUMULATOR STRUCTURE

[76] Inventor: Edward Bottum, 525 N. Fifth St., Brighton, Mich. 48116

[21] Appl. No.: 458,617

[22] Filed: Jan. 17, 1983

[51] Int. Cl.[3] ..... F25B 43/00

[52] U.S. Cl. ..... 62/503; 62/513

[58] Field of Search ..... 62/113, 503, 513

[56] References Cited

U.S. PATENT DOCUMENTS

| | | | |
|---|---|---|---|
| 2,624,181 | 1/1953 | Erwin et al. | 62/503 |
| 3,012,414 | 12/1961 | LaPorte | 62/503 |
| 3,621,673 | 11/1971 | Foust | 62/503 |
| 3,837,177 | 9/1974 | Rockwell et al. | 62/503 |
| 3,955,375 | 5/1976 | Schumacher | 62/503 |

*Primary Examiner*—Ronald C. Capossela

*Attorney, Agent, or Firm*—Barnes, Kisselle, Raisch, Choate, Whittemore & Hulbert

[57] ABSTRACT

Suction accumulator structure and method. The structure comprises an outer cylindrical tank having a top and a bottom, a short tube extending through the top of the tank for passage of gaseous phase change material into the tank, a small diameter elongated tube extending into the tank through the top thereof substantially to the bottom of the tank, a large diameter tube having a substantially closed bottom, and an open top sleeved over the small diameter tube, a hollow coil spirally positioned and in radially spaced relation to the large diameter tube and means for passing a heated, heat transfer medium through the coil. The method of the invention comprises wrapping a coil around the suction tube of a suction accumulator and passing a heated heat transfer medium therethrough whereby liquid phase change material within the suction tube which may be metered into the suction tube is vaporized prior to passage out of the suction accumulator.

8 Claims, 1 Drawing Figure

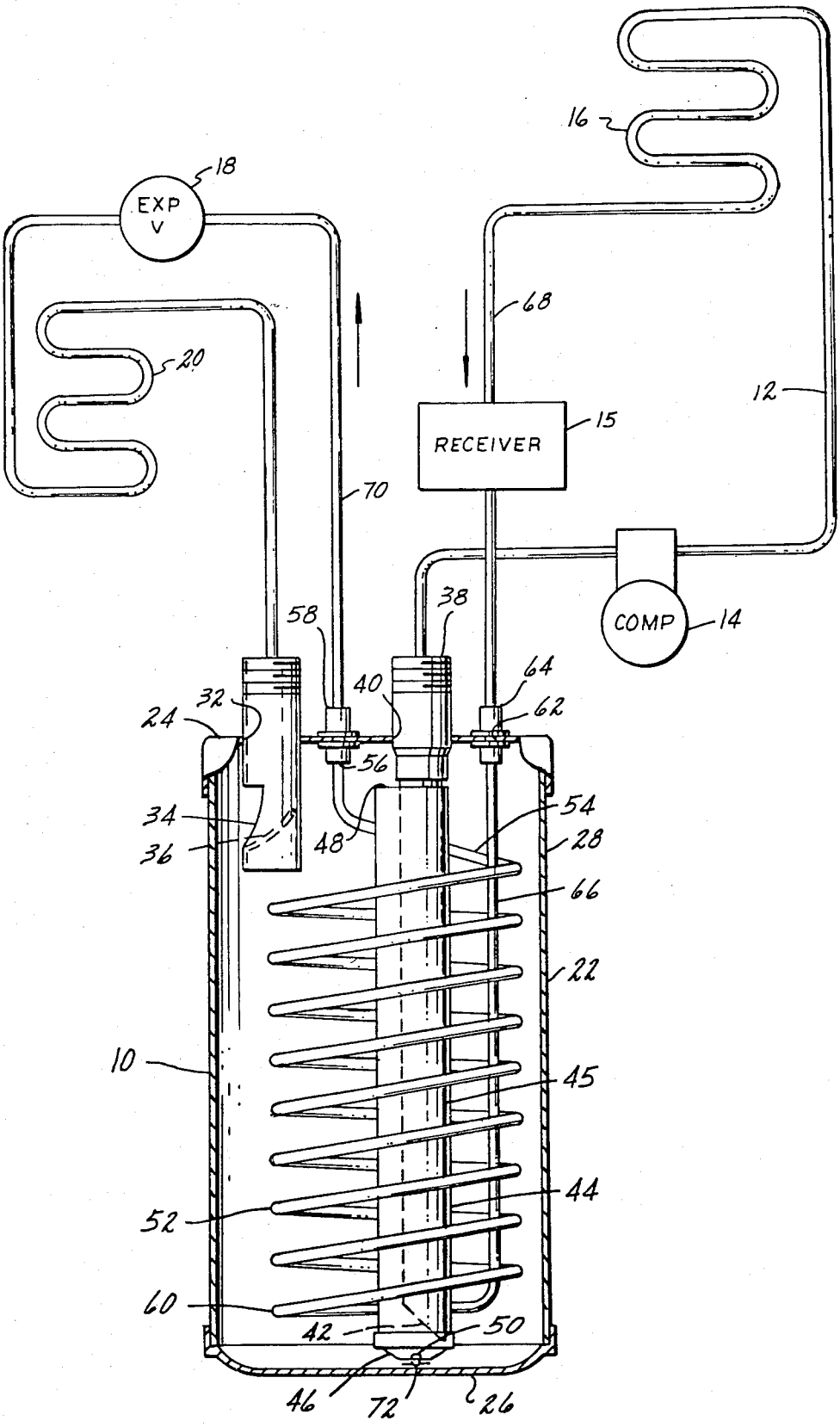
EXP V
RECEIVER
COMP
18
16
20
68
12
15
70
14
58
38
64
40
62
32
24
56
34
54
48
28
36
66
22
10
45
44
52
60
42
50
46
72
26

SUCTION ACCUMULATOR STRUCTURE

BACKGROUND OF THE INVENTION

1. Field of the Invention

The invention relates to suction accumulator structures and methods and refers more specifically to a suction accumulator having a suction tube therein for discharging gaseous phase change material therefrom and including a hollow coil spaced between the outside diameter of the suction tube and the inside diameter of the suction accumulator body through which a heated heat transfer medium may be passed to vaporize liquid phase change material within the accumulator prior to discharge thereof and a method including positioning a hollow coil around and in spaced relation to a suction tube in a suction accumulator and passing a heated heat transfer medium therethrough whereby liquid phase change material within the accumulator is vaporized prior to discharge from the suction accumulator.

2. Description of the Prior Art

In the past, suction accumulators have been provided for use in refrigeration systems and the like in which systems a gaseous, phase change material is passed into an outer tank and is subsequently removed therefrom through an elongated suction tube one end of which opens into the tank adjacent the top of the tank and the other end of which tube ultimately passes out of the tank top. One such suction accumulator is illustrated in U.S. Pat. No. 3,837,177, issued to the inventor of the present invention. The disclosure of U.S. Pat. No. 3,837,177 is included herein by reference.

As specified in U.S. Pat. No. 3,837,177 in refrigeration systems, without suction accumulators, during the system off cycle large quantities of liquid may find their way into the compressor which can cause serious damage to the compressor and greatly impede the efficiency of the refrigeration system.

With the use of a suction accumulator, in such systems a phase change material such as a refrigerant has in the past been collected in the accumulator and slowly metered to the compressor. Controlled metering protects the compressor against undue shock resulting from large amounts of liquid phase change material being suddenly injected into the compressor from the suction tube.

The metering also prevents liquid refrigerant from forcing the oil out of the bearings of the compressor causing bearing wash-out, ultimately resulting in the bearings and compressor motor burning out.

Often in prior art suction accumulators a small opening is provided in the bottom of the suction tube whereby small amounts of liquid refrigerant are metered into the exhaust tube from the accumulator tank. Such metering reduces the possibility of damage to the compressor due to large slugs of liquid refrigerant being passed thereto.

SUMMARY OF THE INVENTION

In accordance with the structure and method of the present invention, liquid phase change material in an accumulator is heated by means of a heat transfer medium passed through a hollow coil within the accumulator but outside of the tube within a tube type suction tube so that the liquid is vaporized before passing out of the suction accumulator.

The structure of the invention includes an outer cylindrical tank having a top and bottom, a short tube for passing gaseous phase change material into the cylindrical tank through the top thereof, a suction tube including a small diameter elongated tube passing into the tank through the top and terminating adjacent the bottom of the tank, a large diameter tube sleeved over the small diameter tube having a substantially closed bottom and open top whereby gaseous phase change material from the accumulator tank is drawn through the top of the large diameter tube, is taken in through the bottom of the small diameter tube and exits the tank through the end of the small diameter tube passing through the top of the tank. Further, in accordance with the invention, a hollow spiral tube is spaced outside the large diameter suction tube, the opposite ends of which pass through the top of the tank. A heated heat transfer medium such as a liquid phase change material passing between a condenser and an expansion valve in the refrigeration system is passed through the coil to heat the liquid phase change material in the suction accumulator to vaporize it prior to its being passed out of the suction accumulator.

The method of the invention includes placing the hollow coil around the suction tube of the suction accumulator in spaced relation thereto and passing a heated, heat transfer medium through the hollow coil. In addition, the method includes metering a controlled amount of liquid phase change material into the suction tube of the suction accumulator from the bottom of the tank to be vaporized prior to its exhaust from the tank.

BRIEF DESCRIPTION OF THE DRAWINGS

The drawing is a partially broken away section view of the suction accumulator of the invention for practicing the method of the invention connected in a refrigeration system.

DESCRIPTION OF THE PREFERRED EMBODIMENT

As shown in the FIGURE, the suction accumulator 10 of the invention is connected into a basic refrigeration system 12. In addition to the accumulator 10, the refrigeration system 12 includes the compressor 14, condenser 16, receiver 15, expansion valve 18 and an evaporator 20, connected as shown in the FIGURE.

More specifically, the suction accumulator 10 includes the outer tank 22 having a top 24 and bottom 26 separated by a circular cylindrical body member 28.

A short inlet tube 30 is secured in opening 32 by convenient means such as brazing. Tube 30 has the opening notch 34 adjacent the bottom thereof within the tank 22 and the baffle 36 therein for deflecting gaseous phase change material from the tube 30 into the outer tank 22 adjacent the top thereof.

An elongated small diameter tube 38 extends through opening 40 in the top 24 to which it is again secured by convenient means such as brazing and is terminated at its beveled bottom end 42 adajcent the bottom 26 of the tank 22. A larger diameter elongated tube 44 having a substantially closed lower end 46 and an open upper end 48 is sleeved over and supported from the smaller diameter tube 38 as shown in the FIGURE.

Thus, gaseous refrigerant from the tank 22 is drawn in the end 48 of the larger diameter tube 44 from the tank 22 and is passed from the bottom of the large diameter tube 44 into the lower end 42 of the small diameter tube 38. Together the small diameter tube 38 and the large diameter tube 44 form the suction tube 45 of the suction accumulator 10.

The gaseous refrigerant is then drawn into the compressor 14 under suction forces created on operation of the compressor 14.

A small metering orifice 50 is provided in the end 46 of the large diameter tube 44 as shown in the FIGURE for a purpose to be considered subsequently.

Optionally, a screen 72 of suitable mesh is provided to cover the metering orifice 50 and prevent it from becoming plugged.

Further, in accordance with the invention, a hollow coil 52 is spirally positioned inside the body 28 but outside the larger diameter tube 44. The upper end 54 of the coil 52 is passed out of the tank 22 through the opening 56 and coupling means 58 which again may be brazed to the top 24 of the suction accumulator 10.

The lower end 60 of the coil 52 extends out of the opening 62 in the top 24 within the coupling 64 by virture of the elongated straight extension 66 thereof.

As shown, the condenser 16 is connected to coupling 64 through tube 68 and receiver 15 while the coupling 58 is connected to the expansion valve 18 through tube 70.

Thus, in operation of the suction accumulator 10 in accordance with the method of the invention, the refrigeration system 12 charged with a phase change material operates in its normal manner. That is, the compressor 14 receives gaseous refrigerant from the suction accumulator 10 through the suction tube 45 including the small diameter tube 38 and the large diameter tube 44. The gaseous refrigerant is compressed and passed to the condenser 16. The refrigerant when it leaves the condenser 16 is in a heated liquid state.

In the heated liquid state, the refrigerant is passed through the bottom 60 of the spirally wound coil 52 and after traversing the coil 52 exits from the suction accumulator 10 at the top 24 thereof. The refrigerant, still in a liquid state, enters the expansion valve but at a lower temperature. After expansion, the cooled refrigerant gas is passed through the evaporator 20 and enters the suction accumulator through tube 30 in a gaseous state.

In such operation, some unvaporized liquid refrigerant may unexpectedly pass through the evaporator 20 causing a flood back, or liquid refrigerant may collect in the suction line leaving the evaporator during the off cycle. If there were no accumulator and the suction line leaving the evaporator were connected directly to the compressor this would result in large slugs of refrigerant being passed into the compressor 14 particularly if the compressor 14 is operated intermittently. As set forth above, such fluid slugs can seriously damage the compressor.

However, when a suction accumulator is inserted between the evaporator and compressor, then the liquid will be held in the main body of the accumulator and metered back through orifice 50 at a rate that will not damage the compressor.

As indicated above, the liquid refrigerant in the suction accumulator tank is metered from the main body into the suction tube 45 of the accumulator by means of the metering opening 50 in the bottom 46 of the pipe 44.

Further, in accordance with the method of the invention, the liquid refrigerant in the accumulator body is heated due to the passage of the hot liquid refrigerant through the coil 52 whereby more of it passes out of the suction accumulator 22 in the preferred gaseous state thereof.

Thus, the suction accumulator of this invention is particularly effective in preventing damage to the refrigeration compressor. It is relatively easy to manufacture and trouble free.

Further, sub-cooling of the liquid refrigerant before the point of expansion improves the performance of the refrigeration system.

Also, the capacity of the condensing unit is effectively increased since suction vapor returning to the compressor will preferably be superheated while vapor leaving the evaporator can approach saturation.

While one embodiment of the present invention has been considered in detail, it will be understood that other embodiments and modifications thereof are contemplated by the inventor. Thus, for example hot discharge gases in ice making machines may be similarly utilized to vaporize a phase change material prior to its introduction into a compressor or the like or for hot gas defrost cycles. It is the intention to include all modifications and embodiments of the invention as are defined by the appended claims within the scope of the invention.

I claim:

1. A suction accumulator including an outer tank, means for passing gaseous phase change material into the outer tank, a suction tube secured to the outer tank extending through the top of the outer tank toward the bottom thereof for withdrawing gaseous phase change material from the outer tank adjacent the top thereof and for passing the gaseous phase change material out of the outer tank, a hollow coil spaced between the inside of the body and the suction tube and means for passing a heated heat transfer material into the coil at the bottom of the suction tube and out of the coil at the top of the suction tube completely through the coil whereby liquid phase change material in the accumulator is vaporized prior to passage out of the outer tank.

2. Structure as set forth in claim 1, wherein the suction tube includes an elongated smaller diameter tube extending out of the top of the outer tank and a larger diameter elongated tube sleeved over the smaller diameter tube which is open at the top and substantially closed at the bottom whereby gaseous refrigerant enters the outer tube at the open top thereof, passes to the bottom of the large diameter tube, is drawn in the bottom of the smaller diameter tube and subsequently passes out of the top of the smaller diameter tube and wherein the coil is spaced outside the exterior of the large diameter tube.

3. Structure as set forth in claim 2, and further including a metering orifice in the bottom of the large diameter tube for metering a controlled amount of refrigerant from the bottom of the outer tank into the large diameter tube adjacent the bottom of the small diameter tube.

4. Structure as set forth in claim 2, and further including a screen covering the metering orifice for preventing plugging of the orifice.

5. A suction accumulator including an outer cylindricla tank having a closed top and a closed bottom, a short tube extending through the top of the outer tank and terminating adjacent the top of the outer tank through which gaseous refrigerant may be passed into the outer tank, an elongated small diameter tube extending through the top of the outer tank in radially spaced relation to the short tube and terminating adjacent the bottom of the outer tank, a large diameter elongated tube sleeved over the small diameter tube having a substantially closed bottom in closely spaced relation to the bottom of the small diameter tube adjacent the bottom of the outer tank and an open top whereby gaseous phase change material may be drawn through the open top of the large diameter tube to the bottom of the large diameter tube and then into the bottom of the small diameter tube and out of the outer tank through the top thereof, a coil for receiving heat transfer material to be passed therethrough wound around the large diameter tube spirally from the bottom to the top thereof, means for passing the top of the spirally wound tube out of the top of the outer tank of the suction accumulator to discharge liquid phase change material from the spirally wound tube and means for passing hot liquid phase change material through the top of the tank along side of the larger diameter tube and into the bottom of the spirally wound coil whereby liquid phase change material within the accumulator and large diameter tube is vaporized due to heat from the spirally wound tube to prevent passing of liquid phase change material out of the suction accumulator through the small diameter tube.

6. Structure as set forth in claim 5, and further including a metering opening at the bottom of the large diameter tube through which liquid phase change material is passed into the bottom of the large diameter tube from the bottom of the tank in measured quantities.

7. A closed suction accumulator comprising only an outer tank having a circular cylindrical hollow body member a closed bottom and a top, a short inlet tube for passing gaseous phase change material into the suction accumulator extending into the outer tank through the top thereof, an elongated suction tube extending from the top of the tank to adjacent the bottom thereof through which gaseous phase change material is withdrawn from the suction accumulator including a relatively small diameter elongated tube passing through and secured to the top of the tank and terminating near the bottom of the tank and an elongated relatively large diameter tube sleeved over the relatively small diameter tube having a substantially closed bottom in close spaced relation to the bottom of the tank and to the bottom of the small diameter tube and a top terminating adjacent the top of the tank and a heating tube for receiving hot liquid phase change material passing through the top of the tank directly to adjacent the bottom of the tank then spirally around the suction tube and itself from adjacent the bottom of the tank to the top of the tank and then out of the top of the tank to discharge the hot liquid phase change material from the suction accumulator whereby at least part of the condensed phase change material within the tank and the suction tube is vaporized and less liquid phase change material is passed out of the tank through the suction tube.

8. In combination, a separate suction accumulator including a separate tank having a closed bottom and a closed top, a short tube extending into the tank through the top thereof for receiving gaseous phase change material from a separate evaporator, an elongated suction tube passing through the top of the tank, extending longitudinally thereof and terminating closely adjacent the bottom of the tank including a small diameter inner tube secured to the top of the tank and terminating adjacent the bottom of the tank, a larger diameter outer tube sleeved over the small diameter inner tube having a closed bottom immediately adjacent the bottom of the tank and the bottom of the small diameter inner tube and terminating at the top adjacent the top of the tank whereby gaseous phase change material within the tank is taken in at the top of the large diameter tube is passed to the bottom thereof is taken into the bottom of the smaller diameter tube and passed out of the suction tube through the top of the tank to a separate compressor, a heating tube extending through the top of the suction accumulator tank to immediately adjacent the bottom of the tank then spirally around itself and the suction tube toward the top of the tank and out of the top of the tank to pass hot liquid phase change material to a separate expansion valve, a separate expansion valve and separate evaporator connected in series between the discharge end of the heating tube and the receiving end of the small diameter tube, a separate compressor, condenser and receiver connected in series between the top of the small diameter tube of the suction tube and the entrance end of the heating coil whereby liquid phase change material in the suction accumulator is evaporated due to the heat of the heating tube prior to passage out of the suction accumulator to the compressor.

* * * * *